United States Patent [19]

Nishizawa et al.

[11] 4,312,210

[45] Jan. 26, 1982

[54] WARM FORGING METHOD FOR CUP-SHAPED PIECES

[75] Inventors: Masatoshi Nishizawa, Higashikurume; Toshihiro Minami, Kobe; Takeshi Nakahara, Akashi; Toyofumi Hasegawa, Himeji, all of Japan

[73] Assignees: Kobe Steel Limited, Kobe; Nippon Koshuha Steel Co. Ltd., Tokyo, both of Japan

[21] Appl. No.: 130,429

[22] Filed: Mar. 14, 1980

[30] Foreign Application Priority Data

Mar. 17, 1979 [JP] Japan ..... 54-31407
Apr. 3, 1979 [JP] Japan ..... 54-40655

[51] Int. Cl.[3] ..... B21C 23/20; B21C 23/32

[52] U.S. Cl. ..... 72/267; 72/345; 72/43; 72/270

[58] Field of Search ..... 72/267, 266, 257, 253, 72/273, 43, 44, 45, 358, 344, 345, 362, 359; 10/27 E

[56] References Cited

U.S. PATENT DOCUMENTS 1,683,661 9/1928 Felding .
1,978,372 10/1934 Purtell ..... 72/267
2,932,889 4/1960 Kritscher .
3,078,905 2/1963 Sommers et al. ..... 72/391
3,188,849 6/1965 Wisebaker et al. .
3,299,453 1/1967 Van de Meerendonk .
3,347,081 10/1967 Bachmann .
3,487,196 12/1969 Bachmann .
3,566,664 3/1971 Schweizer .
3,588,933 6/1971 Shinopulos et al. .
3,688,322 9/1972 Van de Meerendonk .
3,994,403 11/1976 Steinhauser .
4,078,415 3/1978 Koch et al. .

FOREIGN PATENT DOCUMENTS 551053 12/1959 Belgium ..... 72/267

*Primary Examiner*—Roscoe V. Parker
*Attorney, Agent, or Firm*—Oblon, Fisher, Spivak, McClelland & Maier

[57] ABSTRACT

A method for warm forging a cup-shaped piece is disclosed. In warm forging a blank is heated between 400° and 800° C. and is inserted within a die having a cross sectional area substantially larger than that of the blank. The ends of the blank are clamped between a recess in the die and a recess in an upsetting punch and the upsetting punch compresses the blank until its sides become sufficiently bulged to almost touch, or touch, the sides of the die. The upsetting punch is then removed and a backward extruding punch is press fitted into the bulged blank and the blank is extruded to form a cup. The extrusion punch is lubricated and cooled by lubricant and coolant applicators at a position remote from the die so that the blank is not prematurely cooled by the coolant.

11 Claims, 15 Drawing Figures

WARM FORGING METHOD FOR CUP-SHAPED PIECES

BACKGROUND OF THE INVENTION

1. Field of the Invention

This invention relates to a semi-hot forging (hereinafter referred to as warm forging) method for forming a cup-shaped piece by using a relatively thin blank, the forged cup-shaped piece having a open end with a greater sectional area than that of the blank. More particularly, the invention provides such a warm forging method for a cup-shaped piece according to which the blank is subjected to a warm treatment and upset in the form of the bulged shape in an open forging die with both ends of said blank being clamped, and then a punch is press-fitted thereinto to extrude the forged piece backwardly.

This invention also relates to a method intended to enable a smooth backward extrusion forging operation by effectively performing lubrication and cooling of the punch which directly participates in the backward extruding operation.

2. Description of the Prior Art

Generally, for producing a relatively shallow cup-shaped piece such as a chain roller, bearing race, nut, etc., or a deep cup-shaped hollow and tough piece, a prototype thereof is first forged, then cut off, drilled and further worked and polished into the product. The forged intermediate product is a bottomed cylindrical piece, which is then subjected to drilling, cutting and other work. Such a first forging (intermediate product) is usually cup-shaped, so that it is hereinafter referred to as cup-shaped piece.

Forging of such a cup-shaped piece is usually practiced by hot forging, and in such case there is employed a backward extrusion system using an open forging die. The blank having a sectional area approximately the outer diameter of the cup-shaped piece to be formed is heated and put into the die, then a backward extrusion punch with a size corresponding to the inner diameter of the cup-shaped piece to be formed is press-fitted into the die from its opening to give shape to the peripheral wall and bottom portion. Finally, the forged piece is ejected by means of a knockout pin previously provided at the die bottom. In some cases, upsetting is performed before press-fitting the punch into the die. In such cases, there is employed a piston-like punch so designed as to cover the whole internal peripheral surface of the die, and the backward extrusion punch is press-fitted after said piston-like punch has been upset on the bottom side of the die. Generally, such upsetting and die forging are performed by separate machines, so that the equipment costs are high, and many and complicated steps are required. Also, heating devices are necessitated and such heating makes it difficult to secure high dimensional accuracy. Further, surface roughening tends to take place due to decarburization.

Therefore, employment of low-cost cold forging is being considered by some manufacturers, but such cold forging involves the problems of increased work load and possible failure of the punch member. Also, since the formed piece is work hardened by the working heat caused during compression forming, there is indicated a drawback that it is necessary to perform softening annealing in the course of, or at the final stage of working.

It is an essential requirement, irrespective of hot forging or cold forging, that the forging blanks of the desired lengths be easily obtained by cutting. In case the blanks are rod-shaped and they are sheared and forged by a same forging device, the smaller the rod diameter, the easier becomes the shearing operation and the more accurate becomes the shear plane. However, it was impossible in cold working to achieve backward extrusion, from a blank having a small cross sectional area, so as to form the cup-shaped piece having a greater inner diameter of the hollow portion thereof than an outer diameter of the blank and also a greater cross sectional area of the hollow portion than that of the blank.

There is also known a warm forging system in which the blank is heated to several hundred degrees C. and then forged.

SUMMARY OF THE INVENTION

The present inventors conceived that utilization of such warm forging system for forging of said cup-shaped pieces would eliminate the cited problems of hot forging and allow inexpensive production of the desired forgings, and further studies under this conception have led to the attainment of the present invention. Thus, according to the present invention, the rod-shaped blank is heated to 400°–800° C., inserted into an opening forging die and upset in the form of a bulged shape under compression with both ends of the blank being clamped, and then a backward extrusion punch is press-fitted into the upset blank in the die to extrude the blank backwardly.

However, in the backward extrusion process by use of a backward extrusion punch, the blank is passed through the die in the direction opposite to the direction of advancement of the punch while sliding along the outer peripheral surface of said punch. Therefore, when the backward extrusion operation is completed, the backward extrusion punch may stay partly embedded in the forged product. Upon completion of the extruding operation, the forging (forged product) is drawn out from the backward extrusion punch and then taken out of the die by a knockout pin. Since the forging may, in some cases, stay fastly stuck to the punch, usually a stripper is provided along side the die for mechanically removing the forging.

In order to prevent failure, the backward extrusion punch is required to stay free of an abnormal rise of temperature due to thermo-conduction from the high-temperature blank and the collateral deterioration of its mechanical properties. It is also essential to lubricate the outer peripheral surface of the punch to keep it safe from pick-up and other troubles between it and the forging. Therefore, the backward extrusion punch has been subjected to cooling by sprinkling of a coolant and the application of a lubricant upon completion of every cycle of operation. According to the conventional cooling method, a cooling device is provided for the backward extrusion punch and a coolant (usually water-diluted lubricant is used) is sprinkled from a coolant pipe just in front of the die. According to such a method, however, the coolant must be necessarily applied to the heated and preformed blank in the die which causes local cooling of the blank. This local cooling may badly affect the formability of the blank particularly when it is small in size, and may also invite excessive shortening of the tool life. In some cases, the backward extrusion operation itself may become impossible to carry on.

The invention therefore also provides an improved backward extrusion forging system according to which a lubricant applicator for lubricating the tip end of the backward extrusion punch is provided in a stripper or alongside the stripper so that lubrication of the tip end of the extrusion punch is performed by using an adhesive lubricant, and then cooling of the extrusion punch, particularly the root portion of the punch is concentrically performed with a coolant sprinkled from a coolant sprinkler during reciprocating motion between the die and the stripper.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
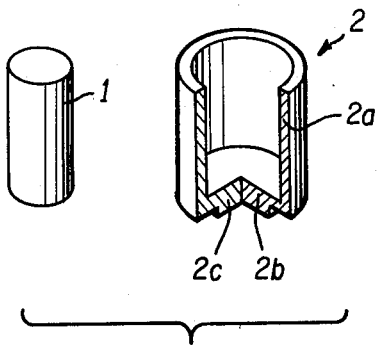
FIG. 1 illustrates a product forged from a blank according to the present invention.

Referring to FIG. 1, there is shown a cup-shaped piece 2 warm-forged from a rod-shaped blank 1 according to this invention. The cup-shaped piece 2 has a vertical peripheral wall 2*a*, a bottom portion 2*b* and, if necessary, a bottom protuberance 2*c*. This cup-shaped piece 2 is an intermediate product which is later subjected to other necessary work such as drilling of the bottom portion 2*b* or cut-off of the peripheral wall 2*a* to form an intermediate product for various parts such as chain rollers, bearing races, nuts, etc.

Figure 3:
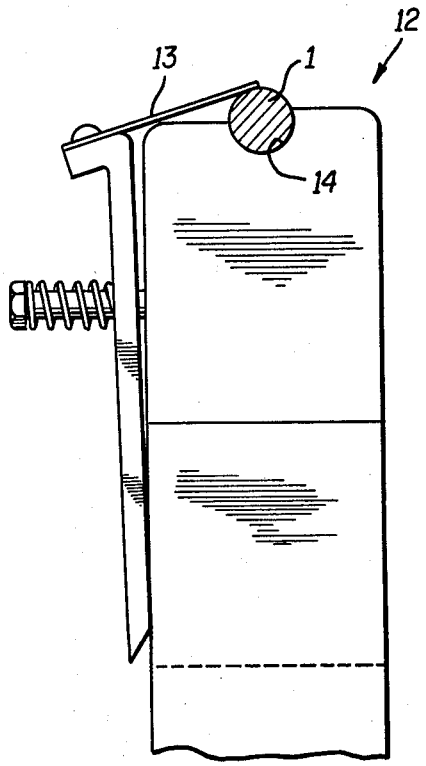
FIG. 3 is a sectional view taken along the line III—III of FIG. 2 and in the direction of arrows.
Figure 2:
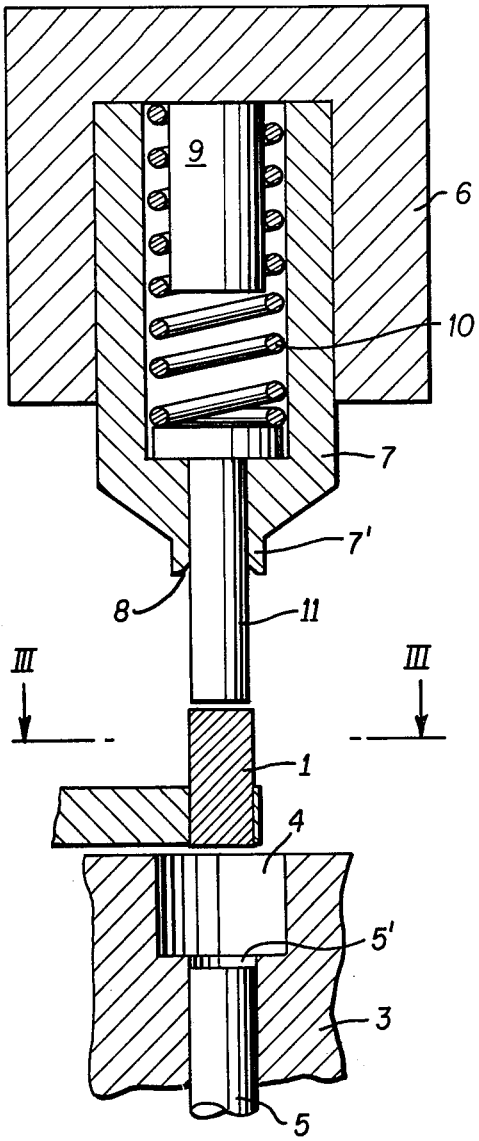
FIG. 2 is a side sectional view showing the construction of the forging means.

FIG. 2 illustrates an apparatus for performing compressed upsetting of a blank 1 by clamping both ends thereof for forming a cup-shaped piece 2 such as shown in FIG. 1 according to the method of this invention. In FIG. 2, numeral 3 indicates a forging die (hereinafter referred to as die) and 4 shows the die cavity. The die 3 is secured to a die block of a forging device and carries thereon a heated blank 1 which is held in position by a spring means 13 fixed to a cutting die 12 which is arranged to be movable back and forth (FIG. 3). A knockout pin 5 is disposed centrally of said cavity 4. Numeral 7 refers to an upsetting punch 7 formed with a beak-like end 7 and which has slidably disposed therein a punch pin 11 which is always urged downwardly (in the drawings) by a coil spring 10. Said knockout pin 5 in the die 3 and said punch pin 11 are centered so that they are axially aligned with each other. Numeral 12 denotes a cutting die adapted to hold the blank 1, heated to 400°-800° C., and carry it, as shown in FIG. 2, to the position where the center of the blank 1 coincides with the center of the die 3. Said cutting die 12, as shown in FIG. 3, is formed with a recession 14 for receiving the blank 1 and is also provided with a holding spring 13 for holding said blank 1 in said recession 14.

Figure 4:
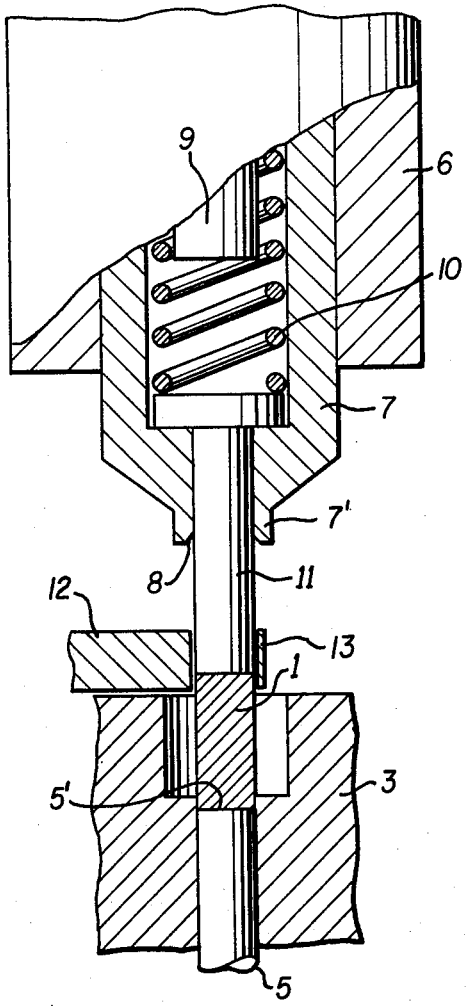
FIG. 4 is an operational illustration of the forging means in FIG. 2.

It will also be seen that the stepped recessions 5 and 8 are provided at the bottom of the cavity 4 and at the beak-like end of the upsetting punch 7, respectively. These recessions inhibit any rightward or leftward movement of the blank during upsetting. The upsetting punch 7, and the punch pin 11, advance toward the blank 1 located between the die 3 and said punch 7 as shown in FIG. 4. The punch pin 11 housed in the upsetting punch 7 is urged by the spring 10 to advance integrally with the punch 7. Thus, the punch pin 11 pushes the blank 1, which is positioned in the path of advancement, to separate the blank from the cutting die 12 and further forces it into the cavity 4 until the foremost end of the blank 1 enters said recession 5'. As this stage is reached, said cutting die 12 is moved away.

Figure 5:
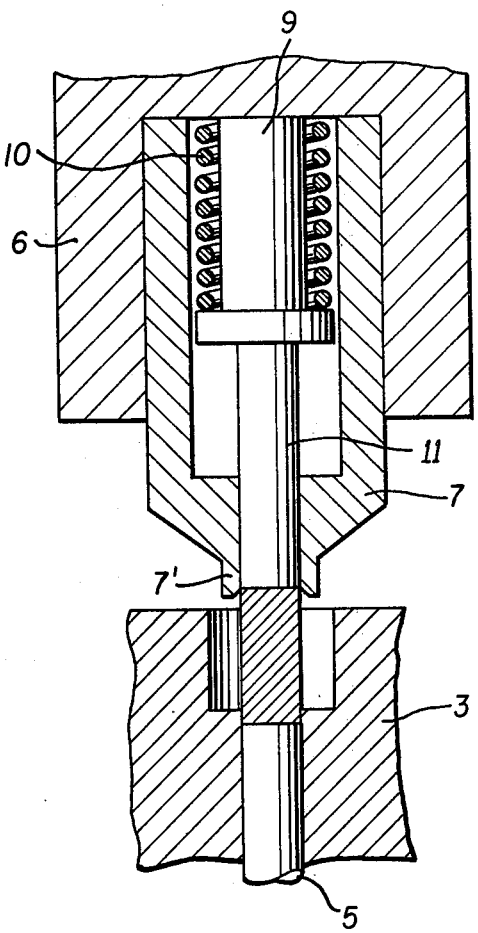
FIG. 5 is also an operational illustration of the forging means in FIG. 2.

As the upsetting punch further advances, the spring 10 is compressed by the punch pin 11 to the position where the punch pin 11 presses against the distance piece 9, and the stepped recession formed at the punch nose clamps the rear end of the blank as shown in FIG. 5. The diameter of the blank 1 is substantially equal to or slightly smaller than the outer diameter of the stepped recessions 8 and 5' so that both ends of the blank 1 are hemmed in and clamped by said stepped recessions 8 and 5', respectively.

Figure 6:
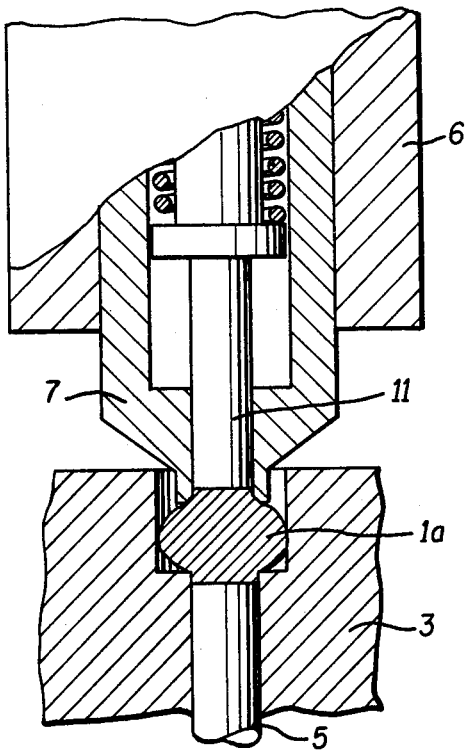
FIG. 6 is an illustration of the upsetting operation.

With further advancement of the upsetting punch 7 and punch pin 11, the blank 1 is compressed and deformed into an upset blank 1*a* in the form of a bulged shape as shown in FIG. 6. Said upsetting is accomplished mostly by the end face of the punch pin 11 and the top face of the knockout pin 5, and since both ends of the blank 1 are clamped by the respective stepped recessions 8 and 5', the central part of the blank swells out symmetrically. In practicing the upsetting in this invention, the upsetting punch advancement is controlled such that the swollen periphery of the bulge-shaped blank will form a slight space from the peripheral wall of the cavity 4 or will slightly contact therewith. When the swollen periphery of the bulged blank contacts the peripheral wall of the cavity 4, it is required to contact the blank with the inner peripheral wall of the die 3 so as not to extremely lower the temperature of the blank. Since the blank 1 used in this invention is a rod with a small diameter, there is obtained a relatively good shear plane to allow uniform attachment with the corresponding faces of the punch pin 11 and knockout pin 5. Also, as both ends of the blank are clamped by the respective stepped recessions, there is no likelihood of off-centered abutment and there is obtained the bulge-shaped blank 1*a* upset symmetrically in the peripheral direction as shown in the drawing. Further, since the blank and the cavity wall of the die 3 are either only slightly spaced apart from each other or slightly contracted with each other, thermal-conduction of blank heat to the die 3 during the warm forging operation is minimized. Further, such upsetting of the small-diametered blank 1 increases not only the amount of compression deformation but also the amount of working heat to facilitate retention and the rise of heat required for the warm forging operation.

Figure 7:
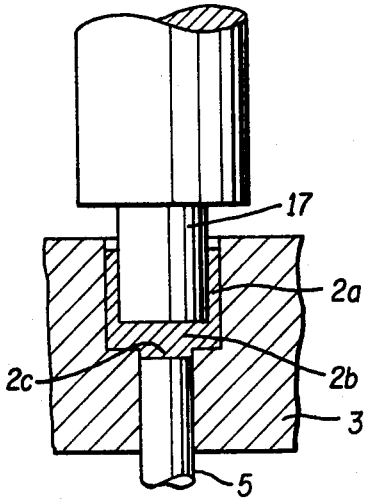
FIG. 7 illustrates the press fitting of a punch.
Figure 8:
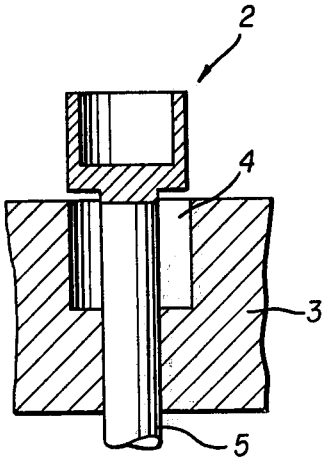
FIG. 8 is an illustration of the cup-shaped piece take-out operation.
Figure 9:
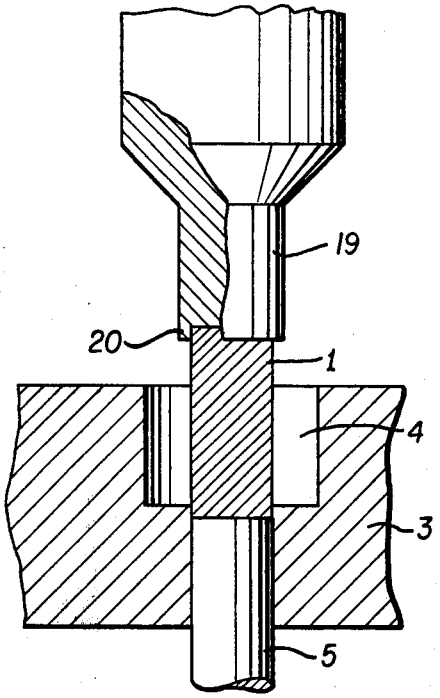
FIG. 9 is an illustration of another embodiment according to this invention.
Figure 10:
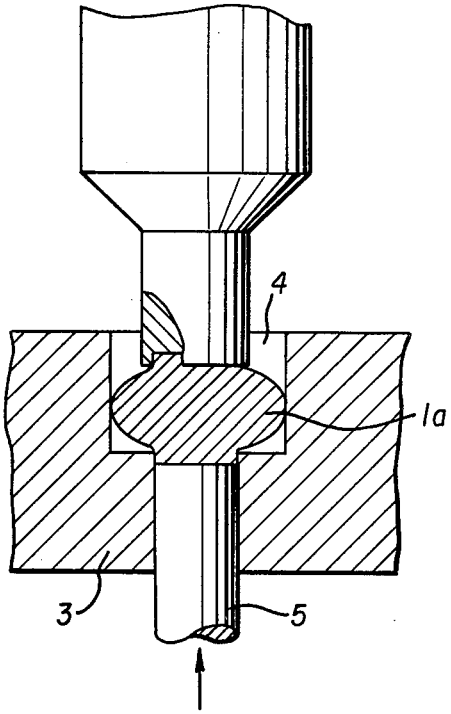
FIGS. 10 and 11 are the illustrations of the forging process by said another embodiment.
Figure 11:
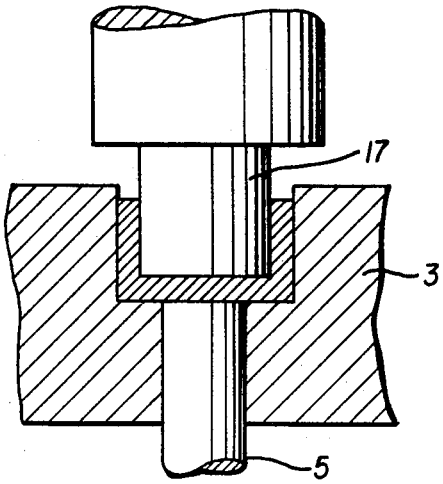
Figure 12:
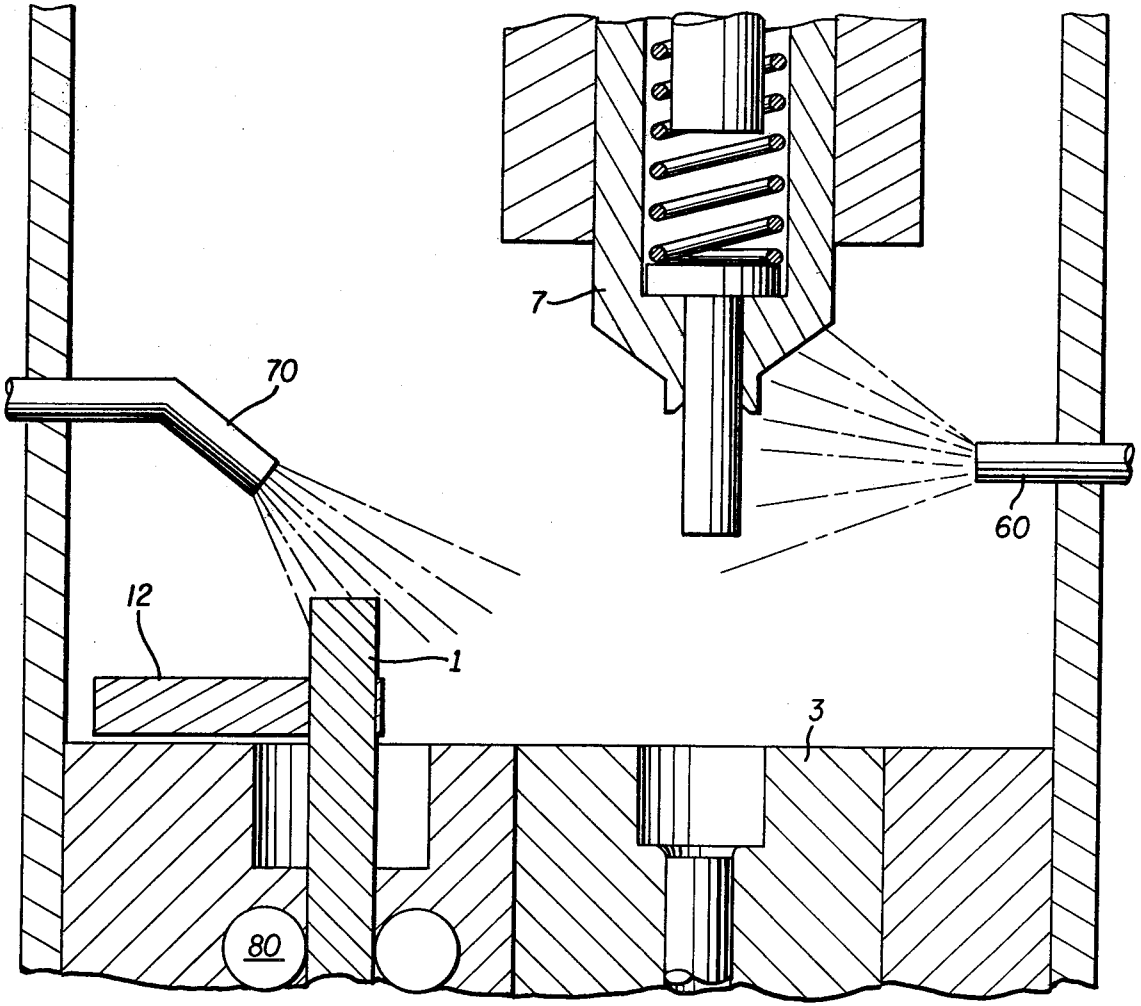
FIG. 12 is a schematic plane view of a backward extrusion forging system and sprinkling means used in the method of this invention.
Figure 13:
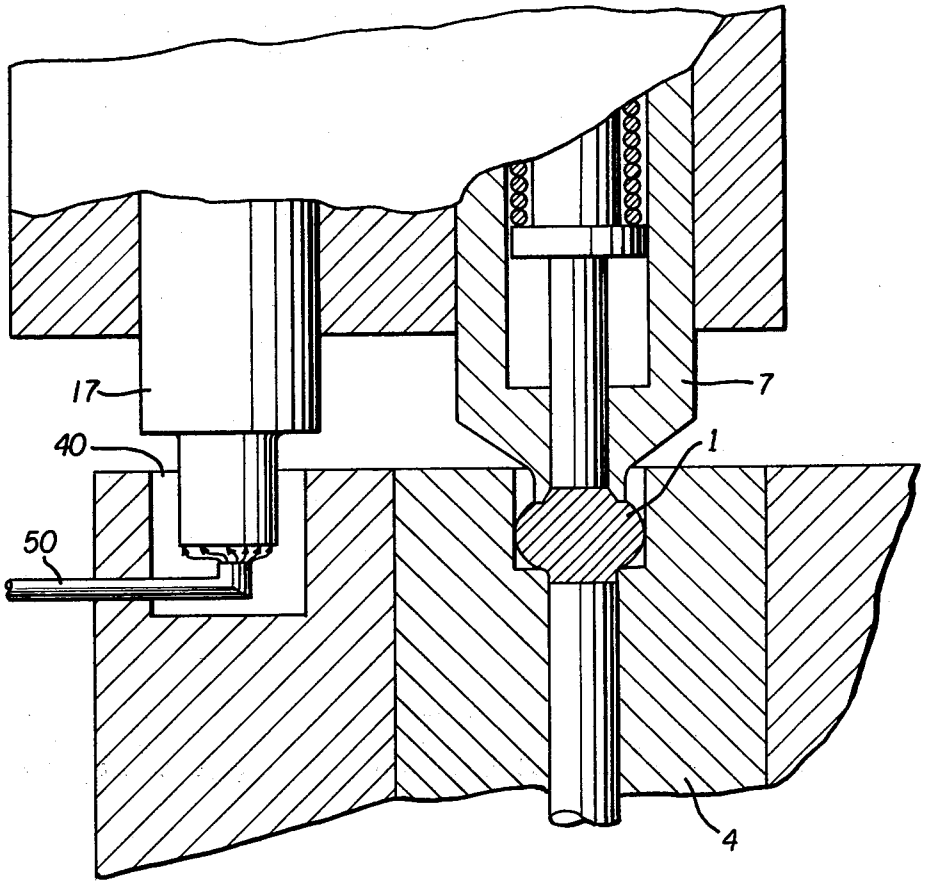
FIGS. 13 and 14 are schematic side elevational views of the system in FIG. 12.

Upon completion of this upsetting operation, the upsetting punch 7 moves away, leaving behind the upset and bulge-shaped blank 1*a* in the die. In such movement, the clamped portion of the blank 1*a* can be easily separated from the stepped recession 8 at the beak-like end 7' because the punch pin 11 is always urged downwards by the spring 10. The upsetting punch 7 is then replaced by a backward extrusion punch 17 such as shown in FIG. 7, and this punch 17 is press-fitted into the upset and bulge-shaped blank 1*a*, whereby the blank 1*a* is deformed so as to fill up the space between it and the cavity 4 to thereby form the peripheral wall 2*a* of the cup-shaped piece 2 as shown in FIG. 7. As the backward extrusion punch 17 recedes away, said knockout pin 5 now moves into the cavity (FIG. 8) to remove the cup-shaped piece 2. The knockout pin 5 shown here is of the type designed to hold the clamped portion at the stepped recession 5' until completion of the forging operation, but if the knockout pin 5 is advanced when the upsetting punch 7 recedes after the end of the operation of FIG. 6 and the punch 17 is press-fitted with the upset and bulge-shaped blank 1*a* being disposed in a state that the bottom surface of the cavity 4 coincides with the tip end surface of the knockout pin 5, it is possible to eliminate the bottom protuberance 2*c*. Also, the bottom surface 2*b* may be formed concave by increasing the amount of projection of the knockout pin. For further working such as drilling in the bottom portion 2*b* of the cup-shaped piece 2, the knocked out hollow piece may be put into another die for piercing the bottom portion 2*b* by a piercing punch. The upsetting punch pin 11 shown here is designed to be slidable relative to the upsetting punch 7, but it is also possible to use upsetting punches with other structures so long as there is provided a stepped recession capable of clamping an end of the blank 1. FIGS. 9 to 11 show an example of the latter case. It will be seen that the upsetting punch 19 is integrally formed, and a stepped clamping recession 20 is formed at the beak-like lower end face thereof. This punch operates in the same way as the aforesaid punch pin 11 to upset the blank 1. The backward extrusion punch 17 is also the same in operation as the one used in the preceding embodiment. Shown here is an embodiment in which the knockout pin 5 advances after recession of the upsetting punch and no protuberance 2*c* is formed at the external bottom surface of the cup-shaped piece 2 after working by the punch 17.

Thus, according to this invention, a rod-shaped blank preheated to 400°–800° C. is upset to form a bulged-shape in an opening of a forging die with both ends of the blank being clamped and the compression deformation thereof is restrained to such an extent that the bulge-shaped blank thus upset will barely contact the cavity wall of the die, and then a backward extrusion punch is press-fitted into the blank to give the desired cup shape thereto. The thus formed cup-shaped piece is then extruded out backwardly. Therefore, this invention has the following advantages:

(1) Since the heated blank is forged into a cup-shaped piece having a greater inner diameter of the hollow portion thereof than the outer diameter of the blank and also a greater cross sectional area of the hollow portion than that of the blank, there is rather evolved working heat to prevent a drop of the temperature during forging.

(2) Since the blank is upset to form the bulged-shape with both ends thereof clamped, a rod-shaped or linear blank with a relatively small diameter can be uniformly compression-deformed with no off-centering, allowing obtainment of a homogenous cup-shaped piece. Also, use of a small-diameter blank is conducive to improvement of blank accuracy.

(3) Both upsetting and forging can be accomplished by using the same die, allowing completion of the whole forging operation in a short time.

(4) Because of warm working, it is possible to prevent cracking during the forging operation and to lessen work load. However, if the heating temperature is below 400° C., cracks develop due to blue brittleness, while a heating temperature above 800° C. is apt to cause scaling of the blank, resulting in poor dimensional accuracy.

(5) Since the blank is smaller in cross sectional area than the hollow portion of the cup-shaped piece as forged, it is possible to use a relatively thin and elongated blank, or a blank with a small surface area, resulting in a minimized drop of the temperature of the blank.

EXAMPLE 1

In order to forge a cup-shaped piece measuring 15 mm in outer diameter, 12 mm in inner diameter and 10 mm in length by using a 1-die-2-blow forging machine and spheroidized bearing steel (JIS SUJ 2) as a blank, said blank steel wire (8.8 mm) was cut to a length of 17 mm and, after heating to 680° C., was upset in a die in a manner described above and forged by using the upsetting punch and backward extrusion punch shown in FIGS. 9 to 11. The temperature of the work piece and the load of the backward extrusion punch 17 were as follows:

Blank temperature before upsetting: 680° C.
Blank temperature after upsetting: 650° C.
Blank temperature after backward extrusion: 670° C.
Backward extrusion stress: 160 kg/mm$^2$
Cross sectional area of blank before upsetting: 61 mm$^2$
Cross sectional area of the hollow portion of cup-shaped piece forged: 113 mm$^2$ By way of comparison, a conventional forging operation was carried out by using the same blank and the same forging machine but without clamping both ends of the blank or upsetting the blank in the form of a bulged shape. The same blank steel wire (8.8 mm) was cut to a length of 8 mm and treated as described above to obtain a cup-shaped piece with dimensions of 9.0 mm outer diameter, 6.0 mm inner diameter and 10 mm length.

Blank temperature before upsetting: 700° C.
Blank temperature after upsetting: 550° C.
Blank temperature after backward extrusion: 350° C.
Backward extrusion stress: 220 kg/mm$^2$
Cross sectional area of blank before upsetting: 61 mm$^2$
Cross sectional area of the hollow portion of cup-shaped piece forged: 28 mm$^2$ Thus, according to the conventional method, heat was absorbed into the die due to contact by upsetting even though the blank was previously heated to a high temperature. This necessitated a corresponding increase of stress of the backward extrusion punch, which amounted to 220 kg/mm$^2$ as shown above. Also, there often took place punch failure in the case of using a backward extrusion punch with an inner diameter of about 6.0 mm.

As described above, this invention can drastically improve the productivity of forging cup-shaped pieces and makes it possible to obtain homogeneous forged products at low cost.

FIGS. 12–15 illustrate the second feature of the present invention. In these drawings, numeral 3 indicates the die, 7 is the upsetting punch for preforming, 17 is the backward extrusion punch designed to perform backward extrusion, element 40 is a stripper for drawing out the forging from the backward extrusion punch, 50 a lubricant applicator installed in said stripper for lubricating the tip end of the backward extrusion punch, 60 a lubricant-containing coolant sprinkler for effecting both cooling and lubrication of the upsetting punch, 70 a lubricant applicator means for applying a lubricant to the blank, and 110 a coolant applicator means provided for the extrusion forging machine for cooling the backward extrusion punch.

In the above system, the blank 1 continuously fed by feed rollers 80 is cut to a predetermined length by a cutting die 12, then applied with a lubricant from a high-pressure nozzle of the lubricant applicator 70 and set in the die 3. Then, the upsetting punch, after undergoing both cooling and lubrication from the applicator 60, performs preforming of the blank in an upset bulged condition in the die under a pressing load in the direction of the die 3, as described above. The lubricant applied from the applicators 60 and 70 may be, for example, a lubricant composed of an oil, fat or mineral oil diluted about 3 to 7 times with water, and such lubricant is sprayed in the form of mist under a spraying pressure of about 8 kg/cm$^2$ to form a good lubricant film on the surfaces of both the blank and upsetting punch.

After preforming by said upsetting punch, the preformed blank is subjected to backward extrusion forging into a cup-shaped piece by the backward extrusion punch 17, as described above. Before this operation, the tip end of the backward extrusion punch is lubricated with an adhesive lubricant applied from the lubricant applicator 50 which is provided in or alongside the stripper 40, and then the extrusion punch, particularly the root portion thereof, is concentrically cooled with a coolant sprinkled from the coolant sprinkler means 110 disposed at the lower dead point of the backward extrusion punch 17. A water-soluble oil, fat or mineral oil diluted about 4 to 5 times with water may be used as coolant. Use of pasty graphite as the adhesive lubricant is preferred in this invention. It is recommended to mix a paste-like mixture of, for example, a water-soluble oil or fat containing 5% of molybdenum disulphide ($MoS_2$) and powdered graphite and apply such paste-like mixture to the tip end of the punch as it flows out from the lubricant applicator 50. Being thus applied, the lubricant won't blow away when the coolant is applied to the punch 17 after lubrication, thus allowing accomplishment of both lubrication and cooling in a desired way. The backward extrusion punch 17 is thus cooled to a temperature below about 200° C., preferably below about 150° C., while forming a lubricant film and is then moved to the position in front of the die 3 to let it perform backward extrusion forging on the preformed blank in the die.

Thus, lubrication of the backward extrusion punch is accomplished at the location of the stripper, and cooling is effected by the coolant sprinkler means as above, so that no coolant application is required when the punch is positioned in front of the die, and hence there is no possibility that the preformed blank in the die is improperly cooled before the backward extrusion step, thus allowing smooth and proper forging while maintaining the blank temperature.

Heating of the blank may be effected by suitable means such as, for example, electric resistance heating before the blank is set in the die 1, and the heating temperature is preferably above about 400° C.

EXAMPLE 2

Figure 14:
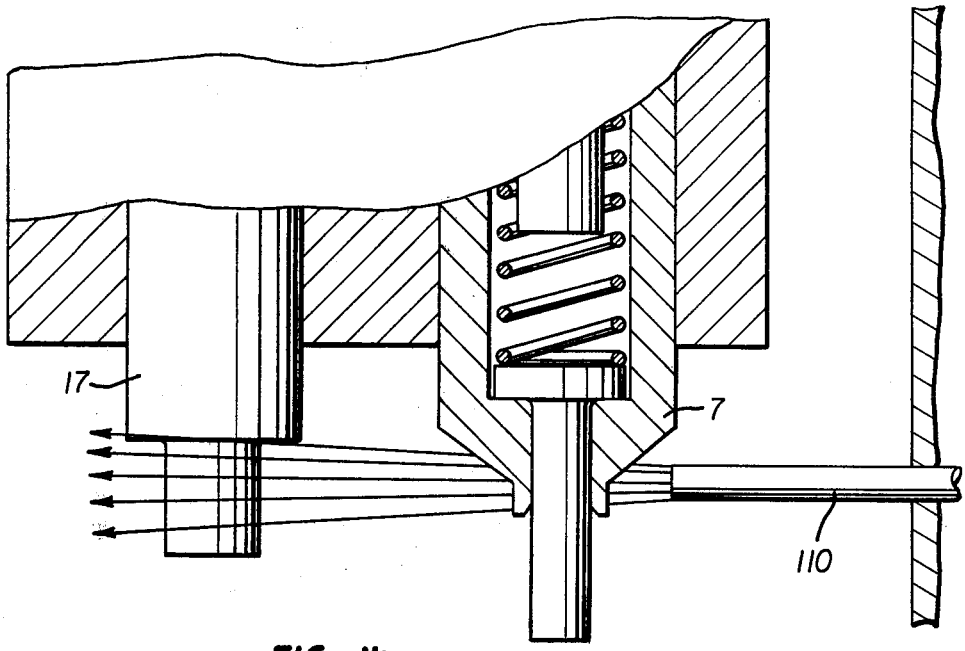
Figure 15:
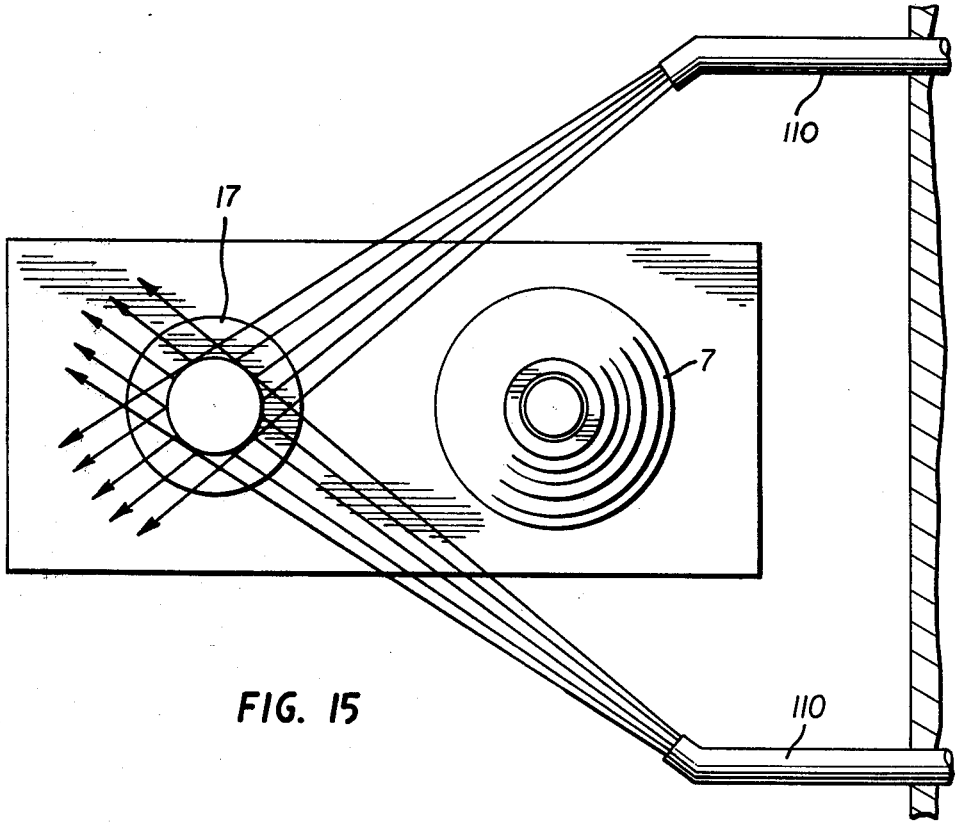
FIG. 15 is a top view of FIG. 14

Continuous warm backward extrusion foging was carried out on a spherodized JIS SUJ 2 steel wire (8.8 mm) in the following procedure by using a 1-die-2-blow forging machine provided with a lubricant applicator 50 in the stripper 40 and a coolant sprinkler 110 at the lower dead point of the backward extrusion punch such as shown in FIGS. 14 and 15.

The blank steel wire (graphite-coated) was heated to 720° C., by electric resistance heating, immediately before forging. The blank was cut to a length of 17 mm, and then a water-soluble oil or fat or mineral oil (diluted 5 times with water) was sprayed on the blank and tools from the spray applicator 70 at a spraying pressure of 8 kg/cm$^2$. The blank temperature at that time was about 680° C. Said mineral oil was simularly applied to the upsetting punch from the applicator 60.

The blank was set in the die 3 and preformed by the upsetting punch, wherein the temperature of the preformed blank was about 650° C. The forging was then extruded backwardly by a backward extrusion punch to which had been applied a paste-like lubricant (a paste-like mixture of a water-soluble oil or fat containing 5% of molybdenum disulphide ($MoS_2$) and powdered graphite) from the lubricant applicator 50 in the stripper 40 and cooled with coolant from the coolant sprinkler 110, thereby obtaining a desired cup-shaped bottomed cylindrical forged product (outer diameter: 15 mm, depth: 10 mm). The blank temperature during backward extrusion was about 670° C. After the backward extrusion operation, the backward extrusion punch 17 was cooled by the coolant sprinkler 110 and lubricated by the lubricant applicator 50, so that in the second and succeeding forging operations, cooling was effected after lubrication.

For the purpose of comparison, a backward extrusion forging operation was carried out according to the conventional method in which cooling was performed in front of the die by spraying lubricant containing coolant from the cooling device mounted to the backward extrusion punch (but other conditions were all same as above). As a result, the blank temperature during backward extrusion by the backward extrusion punch was as low as about 200° C., and the punch failed at a point where the blank was deformed to an extent of several mm in depth by said punch, and no desired backward extrusion forging could be accomplished.

As described above, the method of this invention allows maintenance of the blank at an optimum temperature throughout the operation, can facilitate backward (or backward and forward) extrusion forging operation, can greatly prolong the punch life owing to the reduced work load and thus makes it possible to perform a smooth and stabilized forging operation.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A warm forging method for a cup-shaped piece, said method comprising:

heating a blank to between 400° and 800° C.;

inserting said blank having side walls and a first cross-sectional area into a forging die having side walls and a second cross-sectional area equal to that of the desired cup shaped piece, said first cross-sectional area being smaller than said second cross-sectional area by an amount sufficient that a gap exists between said side walls of said blank and said side walls of said die;

clamping both ends of said blank whereby said blank is centered in said die;

upsetting said blank in said die by an upsetting punch to a degree sufficient that said wall of said blank become bulged in shape by an amount no greater than that at which said walls of said blank barely contact said side walls of said die;

press fitting a backward extrusion punch on said bulged blank in said die; and backwardly extruding said bulged blank in said die to form said cup shaped piece.

2. A warm forging method for a cup-shaped piece, said method comprising:

heating a blank to between 400° and 800° C.;

inserting said blank having side walls and a first cross-sectional area into a forging die having side walls and a second cross-sectional area equal to that of the desired cup shaped piece, said first cross-sectional area being smaller than said second cross-sectional area by an amount sufficient that a gap exists between said side walls of said blank and said side walls of said die;

clamping both ends of said blank whereby said blank is centered in said die;

upsetting said blank in said die by an upsetting punch to a degree sufficient that said walls of said blank become bulged in shape, said bulged shape being centered by said walls of said die;

press fitting a backward extrusion punch on said bulged blank in said die, the cross-sectional area of said backward extrusion punch being greater than said first cross-sectional area; and backwardly extruding said bulged blank in said die to form said cup shaped piece.

3. The method of claim 1 or 2 wherein said blank is upset to a degree sufficient that said bulged walls at least almost contact said side walls of said die.

4. The method of claim 1 or claim 2, wherein one clamped end of said blank is clamped by a central recess of said upsetting punch, said central recess housing a sliding punch pin.

5. The method of claim 4, wherein said punch pin is urged by a coil spring out of said upsetting punch and said punch pin contacts said clamped end of said blank to hold and maintain the position of said blank.

6. The method of claim 4, wherein said central recess is in a beak-like end of said upsetting punch, and said beak-like end and said punch pin are inserted into said die during the upsetting of said blank.

7. The method of claim 1 or 2, wherein said extruded cup-shaped piece and said extrusion punch may be positioned in a stripper for drawing said cup-shaped piece from said extrusion punch.

8. The method of claim 7, wherein said extrusion punch is positioned in said stripper prior to backwardly extruding said blank and wherein said extrusion punch is lubricated with an adhesive lubricant by a lubrication applicator prior to backwardly extruding said blank.

9. The method of claim 8 wherein said lubrication applicator is located in said stripper.

10. The method of claim 8 wherein said lubrication applicator is located adjacent said stripper.

11. The method of claim 1 or claim 2 wherein said extrusion punch is cooled with a coolant applied by coolant applicator means during reciprocating transit of said extrusion punch between said die and a stripper.

* * * * *